US006988064B2

(12) United States Patent
Ramabadran et al.

(10) Patent No.: US 6,988,064 B2
(45) Date of Patent: Jan. 17, 2006

(54) SYSTEM AND METHOD FOR COMBINED FREQUENCY-DOMAIN AND TIME-DOMAIN PITCH EXTRACTION FOR SPEECH SIGNALS

(75) Inventors: Tenkasi V. Ramabadran, Naperville, IL (US); Alexander Sorin, Haifa (IL)

(73) Assignees: Motorola, Inc., Schaumburg, IL (US); International Business Machines Corporation, Armonk, NY (US)

( * ) Notice: Subject to any disclaimer, the term of this patent is extended or adjusted under 35 U.S.C. 154(b) by 212 days.

(21) Appl. No.: 10/403,792

(22) Filed: Mar. 31, 2003

(65) Prior Publication Data

US 2004/0193407 A1 Sep. 30, 2004

(51) Int. Cl.
*G10L 11/04* (2006.01)

(52) U.S. Cl. ..... 704/218; 704/207

(58) Field of Classification Search ..... 704/207–208, 704/216–218, 214

See application file for complete search history.

(56) References Cited

U.S. PATENT DOCUMENTS 4,731,846 A * 3/1988 Secrest et al. ..... 704/207
4,791,671 A * 12/1988 Willems ..... 704/217
5,781,880 A * 7/1998 Su ..... 704/207
6,092,039 A * 7/2000 Zingher ..... 704/221
6,438,517 B1 * 8/2002 Yeldener ..... 704/208
6,526,376 B1 * 2/2003 Villette et al. ..... 704/207

OTHER PUBLICATIONS

McGonegal, Carol A., Lawrence R. Rabiner, and Aaron E. Rosenberg, "A Semiautomatic Pitch Detector (SAPD)," IEEE Trans. Acoust., Speech, and Sig. Proc., ASSP-23/6, Dec., 1975, pp. 570-574.*

* cited by examiner

*Primary Examiner*—Richemond Dorvil
*Assistant Examiner*—Donald L. Storm
(74) *Attorney, Agent, or Firm*—Fleit, Kain, Gibbons, Gutman, Bongini & Bianco P.L.

(57) ABSTRACT

A system, computer readable medium, and method for sampling a speech signal; dividing the sampled speech signal into overlapped frames; extracting first pitch information from a frame using frequency domain analysis; providing at least one pitch candidate, each being associated with a spectral score, from the first pitch information, each of the at least one pitch candidate representing a possible pitch estimate for the frame; extracting second pitch information from the frame using a time domain analysis; providing a correlation score for the at least one pitch candidate from the second pitch information; and selecting one of the at least one pitch candidate to represent the pitch estimate of the frame. The system, computer readable medium, and method are suitable for speech coding and for distributed speech recognition.

30 Claims, 9 Drawing Sheets

516
DELAY UNIT
PITCH CONTOUR HISTORY
504
STFT CIRCUIT
506
FDPCG
SPECTRA
FO CANDIDATES
SPECTRAL SCORES
512
PITCH UNITS CONVERTER
514
LOGIC UNIT
502
FRAMER
SPEECH SIGNAL
FRAMES
FRAMES
PITCH CONTOUR
T CANDIDATES
CORRELATION SCORES
508
RESAMPLER
510
CORRELATION CIRCUIT
DOWNSAMPLED EXTENDED FRAMES

SYSTEM AND METHOD FOR COMBINED FREQUENCY-DOMAIN AND TIME-DOMAIN PITCH EXTRACTION FOR SPEECH SIGNALS

FIELD OF THE INVENTION

The present invention generally relates to the field of speech processing systems, e.g., speech coding and speech recognition systems, and more particularly relates to distributed speech recognition systems for narrow bandwidth communications and wireless communications.

BACKGROUND OF THE INVENTION

With the advent of mobile phones and wireless communication devices the wireless service industry has grown into a multi-billion dollar industry. The bulk of the revenues for Wireless Service Providers (WSPs) originate from subscriptions. As such, a WSP's ability to run a successful network is dependent on the quality of service provided to subscribers over a network having a limited bandwidth. To this end, WSPs are constantly looking for ways to mitigate the amount of information that is transmitted over the network while maintaining a high quality of service to subscribers.

Recently, speech recognition has enjoyed success in the wireless service industry. Speech recognition is used for a variety of applications and services. For example, a wireless service subscriber can be provided with a speed-dial feature whereby the subscriber speaks the name of a recipient of a call into the wireless device. The recipient's name is recognized using speech recognition and a call is initiated between the subscriber and the recipient. In another example, caller information (411) can utilize speech recognition to recognize the name of a recipient to whom a subscriber is attempting to place a call.

As speech recognition gains acceptance in the wireless community, Distributed Speech Recognition (DSR) has arisen as an emerging technology. DSR refers to a framework in which the feature extraction and the pattern recognition portions of a speech recognition system are distributed. That is, the feature extraction and the pattern recognition portions of the speech recognition system are performed by two different processing units at two different locations. Specifically, the feature extraction process is performed on the front-end, i.e., the wireless device, and the pattern recognition process is performed on the back-end, i.e., by the wireless service provider system. DSR enables the wireless device handle more complicated speech recognition tasks such as automated airline booking with spoken flight information or brokerage transactions with similar features.

The European Telecommunications Standards Institute (ETSI) has issued a set of standards for DSR. The ETSI DSR standards ES 201 108 (April 2000) and ES 202 050 (July 2002) define the feature extraction and compression algorithms at the front-end. These standards, however, do not incorporate speech reconstruction at the back-end, which may be important in some applications. As a result, new Work Items WI-030 and WI-034 have been released by ETSI to extend the above standards (ES 201 108 and ES 202 050, respectively) to include speech reconstruction at the back-end as well as tonal language recognition.

In the current DSR standards, the features that are extracted, compressed, and transmitted to the back-end are 13 Mel Frequency Cepstral Coefficients (MFCC), C0–C12, and the logarithm of the frame-energy, log-E. These features are updated every 10 ms or 100 times per second. In the proposals for the extended standards (i.e., the Work Items described above), pitch and class (or voicing) information are also intended to be derived for each frame and transmitted in addition to the MFCC's and log-E. However, the pitch information extraction method remains to be defined in the extensions to the current DSR standards.

A variety of techniques have been used for pitch estimation using either time-domain methods or frequency-domain methods. It is well known that a speech signal representing a voiced sound within a relatively short frame can be approximated by a periodic signal. This periodicity is characterized by a period cycle duration (pitch period) T or by its inverse called fundamental frequency F0. Unvoiced sound is represented by an aperiodic speech signal. In standard vocoders, e.g., LPC-10 vocoder and MELP (Mixed Excitation Linear Predictive) vocoder, time-domain methods have been commonly used for pitch extraction. A common method for time-domain pitch estimation also uses correlation-type schemes, which search for a pitch period T that maximizes the cross-correlation between a signal segment centered at time t and one centered at time t-T. Pitch estimation using time-domain methods has had varying success depending on the complexity involved and background noise conditions. Such time-domain methods in general tend to be better for high pitch sounds because of the many pitch periods contained in a given time window.

As is well known, the Fourier spectrum of an infinite periodic signal is a train of impulses (harmonics, lines) located at multiples of the fundamental frequency. Consequently frequency-domain pitch estimation is typically based on analyzing the locations and amplitudes of spectral peaks. A criterion for fundamental frequency search (i.e., for estimation of pitch) is a high level of compatibility between the fundamental frequency value and the spectral peaks. Frequency-domain methods in general tend to be better for estimating pitch of low pitch frequency sounds because of a large number of harmonics typically within an analysis bandwidth. Since frequency domain methods analyze the spectral peaks and not the entire spectrum, the information residing in a speech signal is only partially used to estimate the fundamental frequency of a speech sample. This fact is a reason for both advantages and disadvantages of frequency domain methods. The advantages are potential tolerance with respect to the deviation of real speech data from the exact periodic model, noise robustness, and relative effectiveness in terms of reduced computational complexity. However, the search criteria cannot be viewed as a sufficient condition because only a part of spectral information is tested. Since known frequency-domain methods for pitch extraction typically use only the information about the harmonic peaks in the spectrum, these known frequency-domain methods used alone result in pitch estimates that are subject to unacceptable accuracy and errors for DSR applications.

SUMMARY OF THE INVENTION

Briefly, in accordance with preferred embodiments of the present invention, disclosed are a system, method and computer readable medium for extracting pitch information associated with an audio signal. In accordance with a preferred embodiment of the present invention, a combination of Frequency-domain and Time-domain methods operate to capture frames of an audio signal and to accurately extract pitch information for each of the frames of the audio signal while maintaining a low processing complexity for a wireless device, such as a cellular telephone or a two-way radio.

A preferred embodiment of the present invention is embodied in a distributed voice recognition system.

Additionally, a preferred embodiment may be embodied in any information processing system that utilizes speech coding related to speech audio signals.

In an embodiment of the present invention, a pitch extractor extracts pitch information of audio signals being processed by a device or system. The device or system, for example, includes a microphone for receiving audio signals. The pitch extractor extracts pitch information corresponding to the received audio signals.

The preferred embodiments of the present invention are advantageous because they serve to improve processing performance while accurately extracting pitch information of a speech signal and thereby increasing communications quality. The improved processing performance also extends battery life for a battery operated device implementing a preferred embodiment of the present invention.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION

Figure 1:
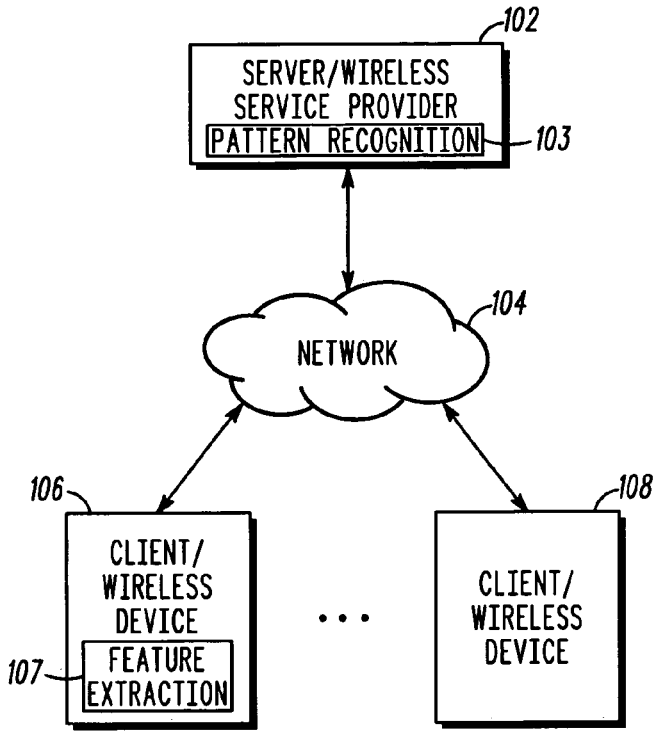
FIG. 1 is a block diagram illustrating networked system suitable for distributed speech recognition according to a preferred embodiment of the present invention.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically. The terms program, software application, and the like as used herein, are defined as a sequence of instructions designed for execution on a computer system. A program, computer program, or software application may include a subroutine, a function, a procedure, an object method, an object implementation, an executable application, an applet, a servlet, a source code, an object code, a shared library/dynamic load library and/or other sequence of instructions designed for execution on a computer system.

The present invention, according to a preferred embodiment, advantageously overcomes problems with the prior art by proposing a low-complexity, accurate, and robust pitch estimation method effectively combining the advantages of frequency-domain and time-domain techniques, as will be discussed below. Frequency-domain and time-domain methods, that are utilized in accordance with preferred embodiments of the present invention, complement each other and provide accurate results. For example, frequency-domain methods tend to perform better for low pitch sounds because of a large number of harmonic peaks within the analyzed bandwidth, and time-domain methods tend to perform better for high pitch sounds because of the large number of pitch cycles within a specific time window. An analysis of a speech audio signal using a combination of frequency-domain and time-domain pitch estimation methods, as will be described in more detail below, results in an overall more accurate estimation of pitch for speech audio signals while maintaining relatively low processing complexity for a pitch extraction process.

It is important that pitch extraction methods be accurate, robust against background noise, and low complexity. The reduced complexity of operational methods for pitch extraction is especially important to reduce processing overhead on the front-end device, e.g., the wireless device, that may be seriously limited in processing capability, in available memory and in other device resources, and in available operating power from a small, portable, power source, e.g. a battery. The less amount of processing overhead required of a processor, such as to extract pitch information from a speech signal, the greater the conservation of power in a power source, e.g., a battery, for the wireless device. Customers are constantly looking for longer battery life for wireless devices. By extending battery life for a wireless device, it increases the advantages and benefits to customers and therefore enhances the commercial viability of such a product in the marketplace.

Generally, a preferred embodiment of the present invention processes speech signals sampled in frames by utilizing a combination of frequency-domain and time-domain pitch estimation methods to determine a pitch estimate for each speech signal sample thereby extracting pitch information for each speech signal sample. In the proposals for the extended DSR standards, spectral information (frequency domain information in the form of Short Time Fourier Transform) of an input speech signal is readily available for use by a pitch extraction method. Therefore, a frequency-domain pitch estimation method, according to a preferred embodiment of the present invention, takes advantage of the available spectral information. An overview of a preferred method for pitch estimation is discussed below, and a more detailed description of a novel system and a new and novel pitch estimation method will follow thereafter.

Using the spectral information already available at the DSR front-end (in the form of Short Time Fourier Transform for each frame of speech), a small number of pitch candidates are selected using a frequency-domain method along with associated spectral scores which are a measure of compatibility of the pitch frequency candidate with the spectral peaks in the Short Time Fourier Transform for each frame of speech. For each of the pitch candidates, a corresponding time lag is computed and a time-domain correlation method is used to compute normalized correlation scores preferably using low-pass filtered, down-sampled speech signal to keep the processing complexity low for the time-domain correlation method for pitch estimation. The spectral scores, the correlation scores, and a history of prior pitch estimates are then processed by a logic unit to select the best candidate as the pitch estimate for the current frame. After describing an exemplary system for implementing alternative embodiments of the present invention, the following discussion will describe in detail certain pitch extraction methods in accordance with preferred embodiments of the present invention.

FIG. 1 is a block diagram illustrating a network for Distributed Speech Recognition (DSR) according to a preferred embodiment of the present invention. FIG. 1 shows a network server or wireless service provider 102 operating on a network 104, which connects the server/wireless service provider 102 with clients 106 and 108. In one embodiment of the present invention, FIG. 1 represents a network computer system, which includes a server 102, a network 104 and client computers 106 through 108. In a first embodiment, the network 104 is a circuit switched network, such as the Public Service Telephone Network (PSTN). Alternatively, the network 104 is a packet switched network. The packet switched network is a wide area network (WAN), such as the global Internet, a private WAN, a local area network (LAN), a telecommunications network or any combination of the above-mentioned networks. In another alternative, the network 104 is a wired network, a wireless network, a broadcast network or a point-to-point network.

In the first embodiment, the server 102 and the computer clients 106 and 108 comprise one or more Personal Computers (PCs) (e.g., IBM or compatible PC workstations running the Microsoft Windows 95/98/2000/ME/CE/NT/XP operating system, Macintosh computers running the Mac OS operating system, PCs running the LINUX operating system or equivalent), or any other computer processing devices. Alternatively, the server 102 and the computer clients 106 and 108 include one or more server systems (e.g., SUN Ultra workstations running the SunOS or AIX operating system, IBM RS/6000 workstations and servers running the AIX operating system or servers running the LINUX operating system).

In another embodiment of the present invention, FIG. 1 represents a wireless communication system, which includes a wireless service provider 102, a wireless network 104 and wireless devices 106 through 108. The wireless service provider 102 is a first-generation analog mobile phone service, a second-generation digital mobile phone service or a third-generation Internet-capable mobile phone service.

In this exemplary embodiment, the wireless network 104 is a mobile phone wireless network, a mobile text messaging device network, a pager network, or the like. Further, the communications standard of the wireless network 104 of FIG. 1 is Code Division Multiple Access (CDMA), Time Division Multiple Access (TDMA), Global System for Mobile Communications (GSM), General Packet Radio Service (GPRS), Frequency Division Multiple Access (FDMA) or the like. The wireless network 104 supports any number of wireless devices 106 through 108, which are mobile phones, text messaging devices, handheld computers, pagers, beepers, or the like.

In this exemplary embodiment, the wireless service provider 102 includes a server, which comprises one or more Personal Computers (PCs) (e.g., IBM or compatible PC workstations running the Microsoft Windows 95/98/2000/ME/CE/NT/XP operating system, Macintosh computers running the Mac OS operating system, PCs running the LINUX operating system or equivalent), or any other computer processing devices. In another embodiment of the present invention, the server of wireless service provider 102 is one or more server systems (e.g., SUN Ultra workstations running the SunOS or AIX operating system, IBM RS/6000 workstations and servers running the AIX operating system or servers running the LINUX operating system).

As explained above, DSR refers to a framework in which the feature extraction and the pattern recognition portions of a speech recognition system are distributed. That is, the feature extraction and the pattern recognition portions of the speech recognition system are performed by two different processing units at two different locations. Specifically, the feature extraction process is performed by the front-end, e.g., the wireless devices 106 and 108, and the pattern recognition process is performed by the back-end, e.g., by a server of the wireless service provider 102. As shown in FIG. 1, a feature extraction processor 107 is located in the front-end wireless device 106, while a pattern recognition processor 103 is located in the wireless service provider server 102. The feature extraction processor 107 extracts feature information from speech signals, such as extracting pitch information, and then communicates this extracted information over the network 104 to the pattern recognition processor 103. The feature extraction process, as performed by the feature extraction processor 107 on the front-end wireless device 106 according to a preferred embodiment of the present invention, will be described in more detail below.

Figure 2:
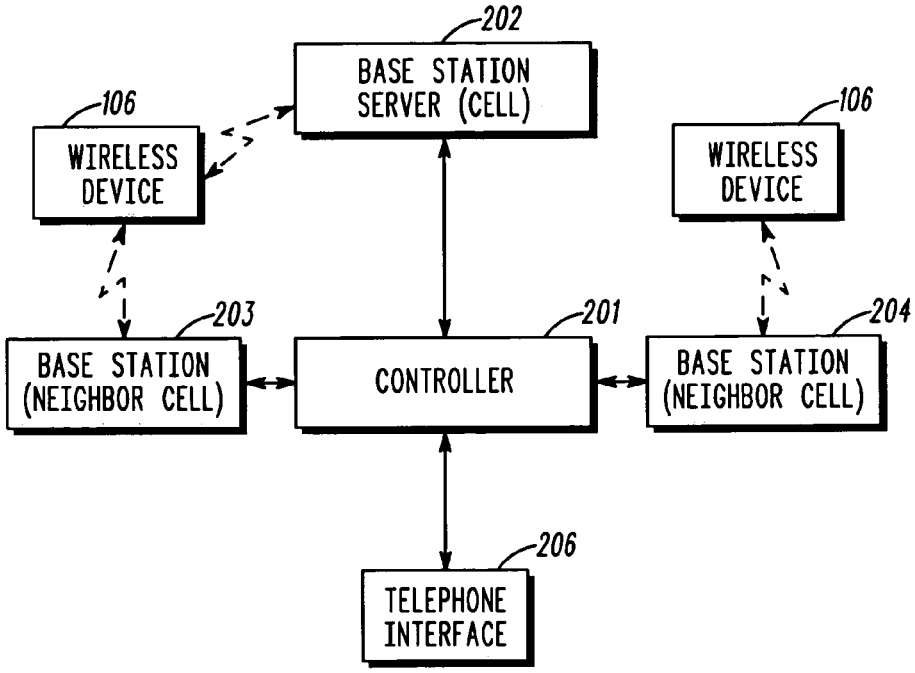
FIG. 2 is a detailed block diagram of a wireless communication system suitable for distributed speech recognition according to a preferred embodiment of the present invention.

FIG. 2 is a detailed block diagram of a wireless communication system for DSR according to an exemplary embodiment of the present invention. FIG. 2 is a more detailed block diagram of the wireless communication system described with reference to FIG. 1 above. The wireless communication system of FIG. 2 includes a system controller 201 coupled to base stations 202, 203, and 204. The system controller 201 controls overall system communications, in a manner well known to those of ordinary skill in the art. In addition, the wireless communication system of FIG. 2 is interfaced to an external telephone network through a telephone interface 206. The base stations 202, 203, and 204 individually support portions of a geographic coverage region containing subscriber units or transceivers (i.e., wireless devices) 106 and 108 (see FIG. 1). The wireless devices 106 and 108 interface with the base stations 202, 203, and 204 using a wireless communication protocol, such as CDMA, FDMA, CDMA, GPRS and GSM. In the exemplary system shown in FIG.2 and with reference to FIG. 1, the wireless device 106 includes a feature extraction processor 107 and provides a front-end for DSR, while the base station 202 includes a pattern recognition processor 103 that while maintaining wireless communication and an interface with the wireless device 106, provides a back-end for DSR. Note also that, in this exemplary system, each of the base stations 202, 203, and 204, includes a pattern recognition processor 103 that while maintaining wireless communication and an interface with a front-end wireless device 106, provides a back-end for DSR with the front-end wireless device 106. It is obvious to those of ordinary skill in the art that the DSR back-end can be located at another point in the overall communication system. For example, controller 201 (see FIG. 2) may include a DSR back-end that processes pattern recognition for the wireless devices 106, 108, communicating with the base stations 202, 203, and 204. Alternatively, the DSR back-end may be located at a remote server across a network communicatively coupled to the controller 201, such as across a wide-area network, such as the Internet, or such as a public switched telephone network (PSTN) via the telephone interface 206. The DSR back-end, for example, may be located at a remote server providing airline booking services. A user of a wireless device 106, for example, may be able to communicate voice commands and inquiries to the remote airline booking server. As is appreciated by those of ordinary skill in the art, any remote application server can benefit from the distributed voice recognition system utilizing a preferred embodiment of the present invention.

The geographic coverage of the wireless communication system of FIG. 2 is divided into coverage areas or cells, which are individually serviced by the base stations 202, 203, and 204 (also referred to herein as cell servers). A wireless device operating within the wireless communication system selects a particular cell server as its primary interface for receive and transmit operations within the system. For example, wireless device 106 has cell server 202 as its primary cell server, and wireless device 108 has cell server 204 as its primary cell server. Preferably, a wireless device selects a cell server that provides the best communication interface into the wireless communication system. Ordinarily, this will depend on the signal quality of communication signals between a wireless device and a particular cell server.

As a wireless device moves between various geographic locations or cells within the geographic coverage of the wireless communication system, a hand-off or hand-over may be necessary to another cell server, which will then function as the primary cell server. A wireless device monitors communication signals from base stations servicing neighboring cells to determine the most appropriate new server for hand-off purposes. Besides monitoring the quality of a transmitted signal from a neighboring cell server, according to the present example, the wireless device also monitors the transmitted color code information associated with the transmitted signal to quickly identify which neighbor cell server is the source of the transmitted signal.

Figure 3:
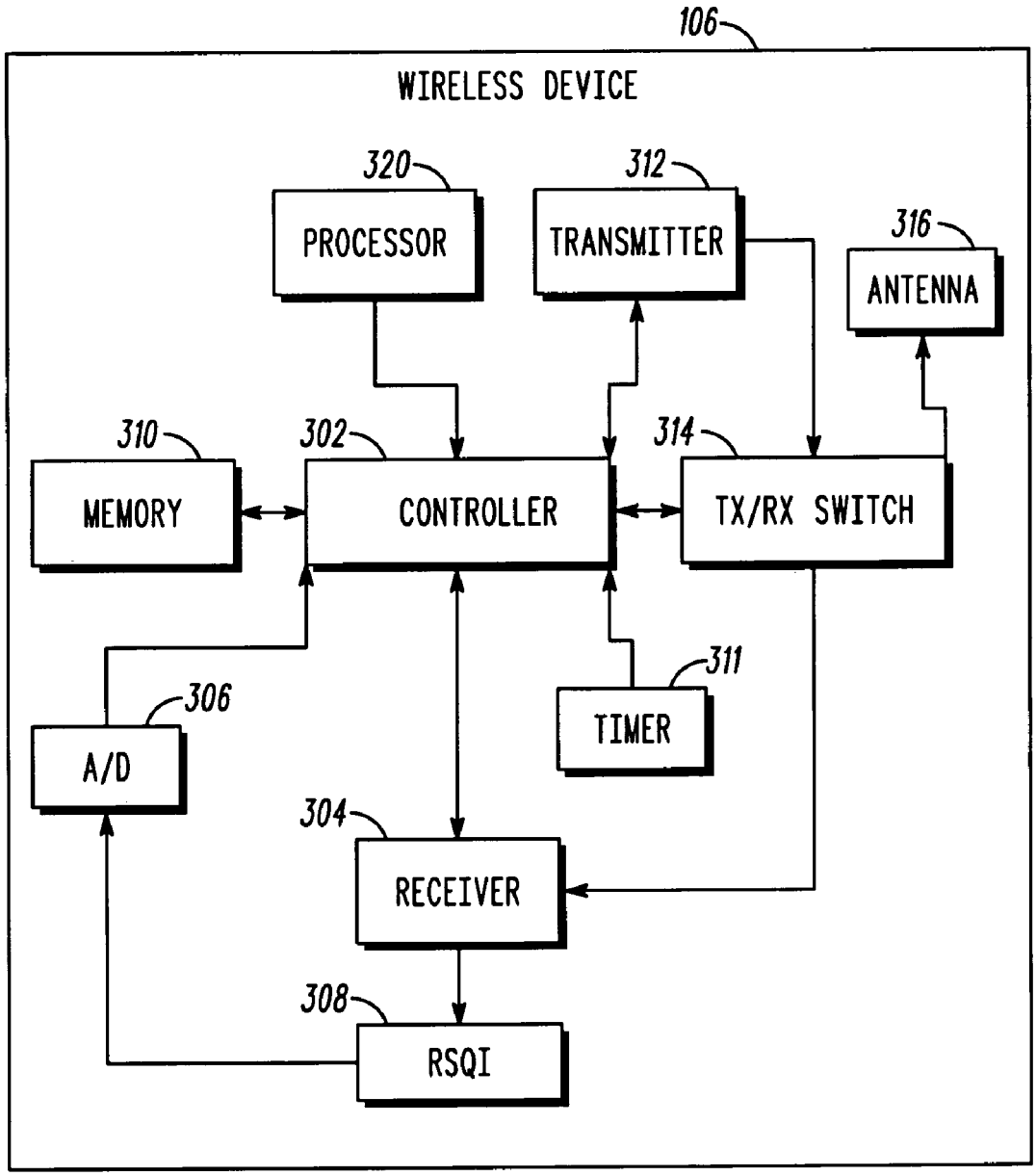
FIG. 3 is a block diagram illustrating a wireless device for operating in a wireless communication system according to a preferred embodiment of the present invention.

FIG. 3 is a block diagram illustrating a wireless device for a wireless communication system according to a preferred embodiment of the present invention. FIG. 3 is a more detailed block diagram of a wireless device described with reference to FIGS. 1 and 2 above. FIG. 3 shows a wireless device 106, such as shown in FIG. 1. In one embodiment of the present invention, the wireless device 106 comprises a two-way radio capable of receiving and transmitting radio frequency signals over a communication channel under a communications protocol such as CDMA, FDMA, CDMA, GPRS or GSM. The wireless device 106 operates under the control of a controller 302 which switches the wireless device 106 between receive and transmit modes. In receive mode, the controller 302 couples an antenna 316 through a transmit/receive switch 314 to a receiver 304. The receiver 304 decodes the received signals and provides those decoded signals to the controller 302. In transmit mode, the controller 302 couples the antenna 316, through the switch 314, to a transmitter 312.

The controller 302 operates the transmitter and receiver according to program instructions stored in memory 310. The stored instructions include a neighbor cell measurement scheduling algorithm. Memory 310, according to the present example, comprises Flash memory, other non-volatile memory, random access memory (RAM), dynamic random access memory (DRAM) or the like. A timer module 311 provides timing information to the controller 302 to keep track of timed events. Further, the controller 302 can utilize the time information from the timer module 311 to keep track of scheduling for neighbor cell server transmissions and transmitted color code information.

When a neighbor cell measurement is scheduled, the receiver 304, under the control of the controller 302, monitors neighbor cell servers and receives a "received signal quality indicator" (RSQI). RSQI circuit 308 generates RSQI signals representing the signal quality of the signals transmitted by each monitored cell server. Each RSQI signal is converted to digital information by an analog-to-digital converter 306 and provided as input to the controller 302. Using the color code information and the associated received signal quality indicator, the wireless device 106 determines the most appropriate neighbor cell server to use as a primary cell server when hand-off is necessary.

Processor 320 shown in FIG. 3 performs various functions such as the functions attributed to distributed speech recognition, described in greater detail below. According to the present example, the processor 320 operating the various DSR functions corresponds to the feature extraction processor 107 shown in FIG. 1. In alternative embodiments of the present invention, the processor 320 shown in FIG. 3 comprises a single processor or more than one processor for performing the functions and tasks described above. The advantageous structure and function of the feature extraction processor 107 of FIG. 1, according to preferred embodiments of the present invention, will be discussed in more detail below.

Figure 4:
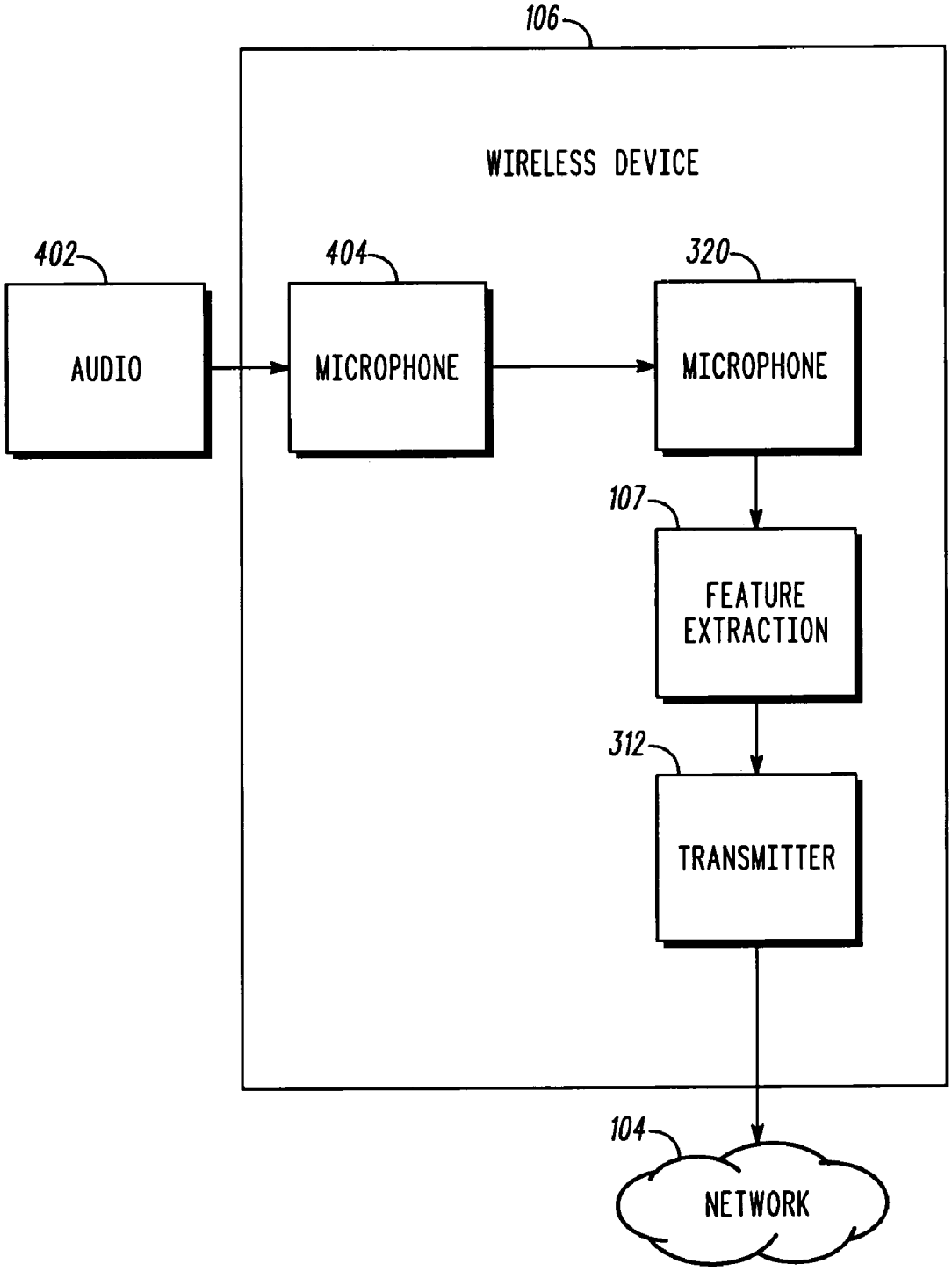
FIG. 4 is a block diagram illustrating components of a wireless device suitable for a front-end for distributed speech recognition according to a preferred embodiment of the present invention.

FIG. 4 is a block diagram illustrating components of a wireless device 106 operating to provide a front-end for DSR with back-end support from the wireless service provider server 102. FIG. 4 will be discussed with reference to FIGS. 1, 2, and 3. It is understood that, in this example, the processor 320 operating with functional components from memory 310 implements functions and features of the front-end for DSR. For example, the feature extraction processor 107, being communicatively coupled with the processor 320, extracts pitch information from a speech signal that is received via the microphone 404 such as when a user provides speech audio 402 to the microphone 404. The processor 320 is also communicatively coupled to the transmitter 312 of the wireless device 106, as shown in FIG. 3, and operates to wirelessly communicate extracted pitch information from the front-end feature extraction processor 107 into a wireless network 104 destined for reception by the server 102 and the pattern recognition processor 103 providing the back-end for DSR.

According to the present example, the wireless device 106 includes the microphone 404 for receiving audio 402, such as speech audio from a user of the device 106. The microphone 404 receives the audio 402 and then couples a speech signal to the processor 320. Among the processes performed by processor 320, the feature extraction processor 107 extracts pitch information from the speech signal. The extracted pitch information is encoded in at least one codeword that is included in a packet of information. The packet is then transmitted by the transmitter 312 via the network 104 to a wireless service provider server 102 that includes the pattern recognition processor 103. The advantageous functional components and processes for extracting pitch information, in accordance with preferred embodiments of the present invention, will be described in more detail below.

Figure 5:
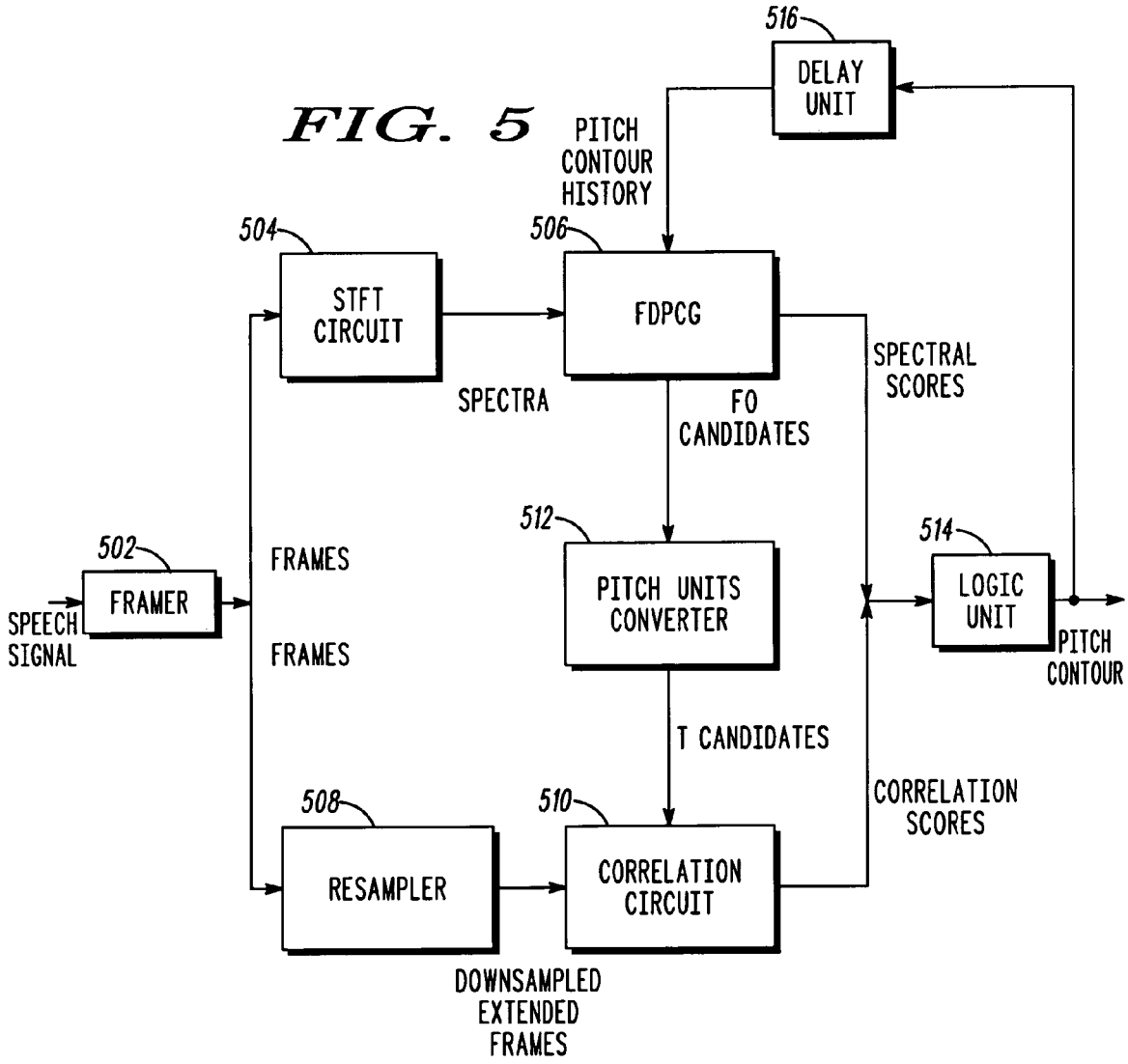
FIG. 5 is functional block diagram illustrating a pitch extraction process, according to a preferred embodiment of the present invention.

FIG. 5 is a functional block diagram illustrating a pitch extraction process performed by the feature extraction processor 107, according to a preferred embodiment of the present invention. The discussion with respect to FIG. 5 will be better understood with reference to FIGS. 1, 2, 3, and 4.

Reference now is made to FIG. 5, which is a simplified functional block diagram that illustrates a pitch estimation system operating in accordance with a preferred embodiment of the present invention. The feature extraction processor 107 of FIG. 1, for example, comprises a pitch extraction system as illustrated in FIG. 5. The pitch extractor of FIG. 5 comprises a Framer 502, a Short Time Fourier Transform (STFT) Circuit 504, a Frequency Domain Pitch Candidates Generator (FDPCG) 506, a Resampler 508, a Correlation Circuit 510, a Pitch Units Converter 512, a Logic Unit 514, and a Delay Unit 516.

An input to the system is a digitized speech signal. The system output is a sequence of pitch values (a pitch contour) associated with evenly spaced time moments or frames. One pitch value represents the periodicity of the speech signal segment at the vicinity of the corresponding time moment. A reserved pitch value, such as zero, indicates an unvoiced speech segment where the signal is aperiodic. In some preferred embodiments, e.g. in the proposals for the extension of ETSI DSR standards, the pitch estimation is rather a sub-system of a more general system for speech coding, recognition, or other speech processing needs. In such embodiments, Framer 502 and/or STFT Circuit 504 may be functional blocks of the parent system, and not of the pitch estimation subsystem. Correspondingly their outputs are produced outside the pitch estimation subsystem and fed into it.

Framer 502 divides the speech signal into frames of a predefined duration, such as 25 ms, shifted relative to each other by a predefined offset, such as 10 ms. Each frame is passed in parallel into STFT Circuit 504 and into Resampler 508, and the control flow is branched as shown on the FIG. 5.

Starting with the upper branch of the functional block diagram, within STFT Circuit 504 a Short Time Fourier Transform is applied to the frame comprising multiplication by a windowing function, e.g. a Hamming window, and Fast Fourier Transform (FFT) of the windowed frame.

Frame spectrum obtained by STFT Circuit 504 is further passed to FDPCG 506, which performs a spectral peaks based determination of pitch candidates. FDPCG 506 may employ any known frequency-domain pitch estimation method, such as that which is described in U.S. patent application Ser. No. 09/617,582, filed on Jul. 14, 2000, now U.S. Pat. No. 6,587,816 entitled "FAST FREQUENCY-DOMAIN PITCH ESTIMATION." the entire teachings of which are hereby incorporated by reference. Some of these methods use pitch values estimated from one or more previous frames. Correspondingly the output of the entire pitch estimation system obtained from Logic Unit 514 (which is described herein below) from one or more previous frames and stored in Delay Unit 516 is fed into FDPCG 506.

A mode of operation of the selected frequency domain method is modified so that, according to this exemplary embodiment, the process is terminated as soon as pitch candidates are determined, that is, before a final choice of a best candidate is made. Thus FDPCG 506 outputs a number of pitch candidates. In the proposals for the extension of ETSI DSR standards, not more than six pitch candidates are produced by FDPCG 506. However, it should be obvious to those of ordinary skill in the art that any number of pitch candidates may likewise be suitable for alternative embodiments of the present invention. The information associated with each pitch candidate comprises a normalized fundamental frequency F0 value (1 divided by pitch period expressed in samples) and a spectral score SS which is a measure of compatibility of that fundamental frequency with spectral peaks contained in the spectrum.

Returning to the flow branching point, each frame is fed into Resampler 508, where the frame is subjected to low pass filtering (LPF) with cut-off frequency Fc, followed by downsampling. In a preferred embodiment of the method, a 800 Hz low pass Infinite Impulse Response (IIR) 6-th order Butterworth filter is combined with a 1-st order IIR low frequency emphasis filter. The combined filter is applied to the last FS samples of the frame, where FS is a relative frame shift, because these are the only new samples that have not been present in previous frames. Resampler 508 maintains a history buffer where LH filtered samples produced from previous frames are stored.

LH is defined as $$LH=2*\text{MaxPitch}-FS,$$

Where, a predefined number MaxPitch is an upper limit of the pitch search range. The new FS samples of filtered signal are appended to the contents of the history buffer resulting in an extended filtered frame of 2*MaxPitch samples length. Then the extended filtered frame is subjected to downsampling, which produces a downsampled extended frame. The downsampling factor DSF is preferably chosen to be slightly lower than the maximal theoretically justified value given by $$DSF=0.5*Fs/Fc$$

where, Fs is a sampling frequency of the original speech signal, in order to avoid aliasing effect resulting from a non-ideal low pass filtering. Such in a preferred embodiment of the method the DSF values of 4, 5 and 8 are used where Fs values are 8000 Hz, 11000 Hz and 16000 Hz respectively. (To be compared with the theoretical values of 5, 6.875 and 10 respectively.)

The downsampled extended frame produced by Resampler 508 is passed to the Correlation Circuit 510. The task of the Correlation Circuit 510 is to calculate a correlation based score for each pitch candidates generated by FDPCG 506. Accordingly, the fundamental frequency values {F0*i*} associated with the pitch candidates produced by FDPCG 506 are converted by Pitch Units Converter 512 to corresponding downsampled lag values {Ti} in accordance with the formula:

$$Ti=1/(F0i*DSF),$$

and fed into Correlation Circuit 510. For each pitch candidate Correlation Circuit 510 produces a correlation score value CS. A preferred mode of operation of the Correlation Circuit 510 is described in greater detail herein below with reference to FIG. 7.

Finally the list of pitch candidates is fed into Logic Unit 514. The information associated with each candidate comprises: a) a fundamental frequency value F0; b) a spectral score SS; and c) a correlation score CS. Logic Unit preferably maintains internally a history information about pitch estimates obtained from one or more previous frames. Using all the abovementioned information Logic Unit 514 chooses a pitch estimate from among the plurality of pitch candidates passed into it or indicates the frame as unvoiced. In choosing a pitch estimate, Logic Unit 514 gives preference to candidates having high (i.e., best) correlation and spectral scores, high fundamental frequency (short pitch cycle period) values and fundamental frequency values close (i.e., best match) to that of pitch estimates obtained from previous frames. Any logical scheme implementing this kind of compromise may be used, as is obvious to those of ordinary skill in the art in view of the present discussion.

Figure 6:
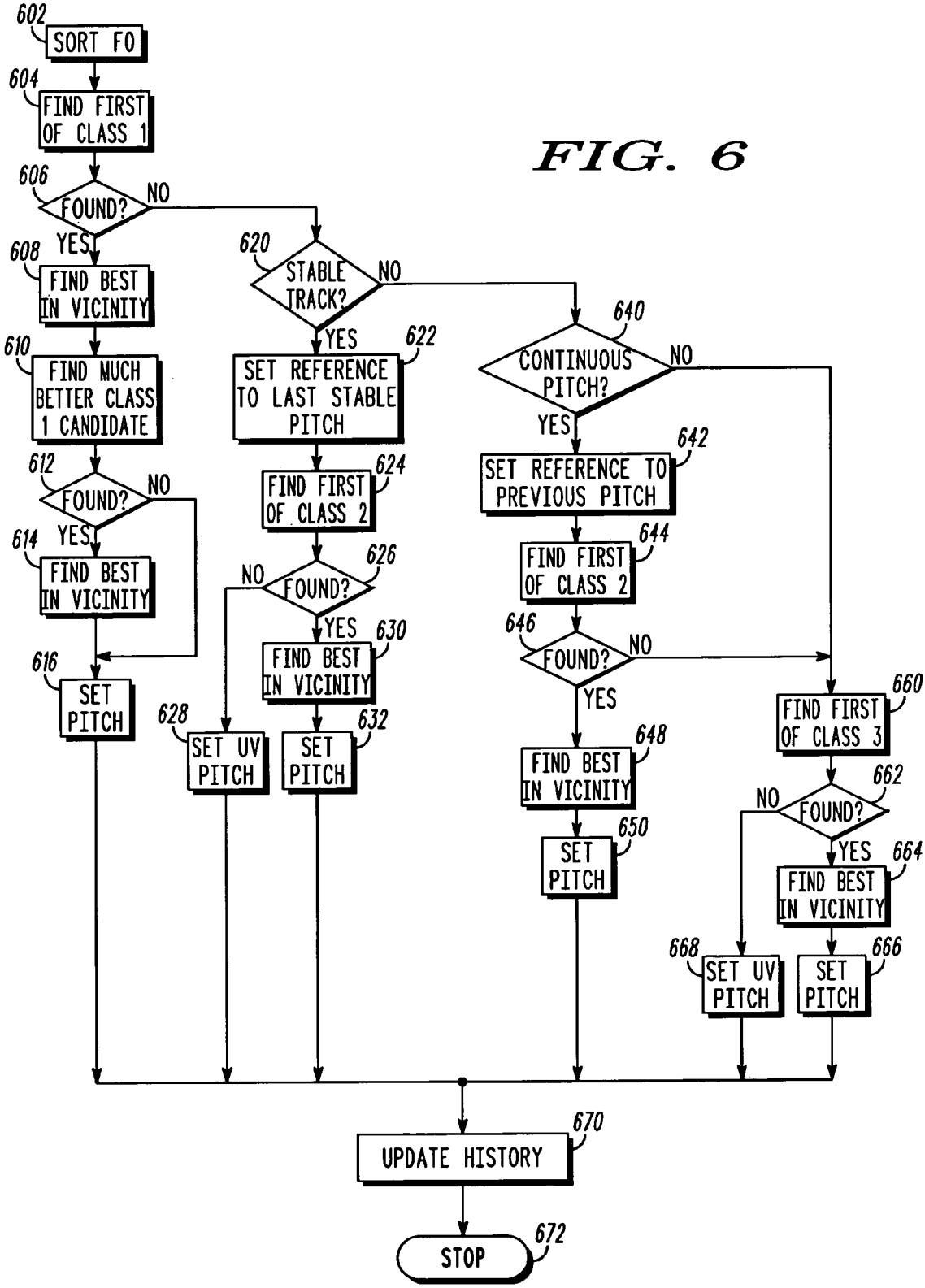
FIGS. 6, 7 and 8 are operational flow diagrams illustrating portions of a pitch extraction process according to a preferred embodiment of the present invention.

FIG. 6 is a flow diagram illustrating an operation of Logic Unit 514 implemented in a preferred embodiment of the method.

The candidates are sorted at step 602 in descending order of their F0 values. Then at step 604 the candidates are scanned sequentially until a candidate of class 1 is found, or all the candidates are tested. A candidate is defined to be of class 1 if the CS and SS values associated with the candidate satisfy the following condition:

$$(CS>C1 \text{ AND } SS>S1) \text{ OR } (SS>S11 \text{ AND } SS+CS>CS1) \qquad \text{(Class 1 condition)}$$

where, C1=0.79, S1=0.78, S11=0.68 and CS1=1.6.

At step 606 the flow branches. If a class 1 candidate is found it is selected to be a preferred candidate, and the control is passed to step 608 performing a Find Best in Vicinity procedure described by the following.

Those candidates among the ones following the preferred candidate are checked to determine which are close in terms of F0 to the preferred candidate. Two values F01 and F02 are defined to be close to each other if:

$$(F01<1.2*F02 \text{ AND } F02<1.2*F01) \qquad \text{(Closeness condition).}$$

A plurality of better candidates is determined among the close candidates. A better candidate must have a higher SS and a higher CS value than those of the preferred candidate, respectively. If at least one better candidate exists then the best candidate is determined among the better candidates. The best candidate is characterized by there being no other better candidate, which has a higher SS and a higher CS value than those of the best candidate, respectively. The best candidate is selected to be a preferred candidate instead of the former one. If no better candidate is found the preferred candidate remains the same.

At step 610 the candidates following the preferred candidate are scanned one by one until a candidate of class 1 is found whose average score is significantly higher than that of the preferred candidate:

$$SS\text{candidate}+CS\text{candidate}>SS\text{preferred}+CS\text{preferred}+0.18$$

or all the candidates are scanned. If a candidate is found which meets the above condition, at step 612, it is selected to be the preferred candidate and Find Best in Vicinity procedure is applied, at step 614. Otherwise the control is passed directly to step 616.

The pitch estimate is set to a preferred candidate at step 616, and the control is passed to update history, at step 670, and then exits the flow diagram, at step 672.

Returning to the conditional branching step 606, if no class 1 candidate is found then, at step 620, it is checked if an internally maintained history information indicates an On Stable Track Condition.

A continuous pitch track is defined as a sequence of two or more consequent frames if a pitch estimate associated with each frame in the sequence is close to the one associated with the previous frame in terms of F0 (in sense of the specified above closeness definition). The On Stable Track Condition is considered fulfilled if the last frame belonging to a continuous pitch track is either the previous frame or the frame immediately preceding the previous frame, and the continuous pitch track is at least 6 frames long.

If the On Stable Track Condition is held true the control is passed to step 622, otherwise to step 640.

At step 622 a reference fundamental frequency value F0ref is set to the F0 associated with the last frame belonging to a stable track. Then at step 624 the candidates are scanned sequentially until a candidate of a class 2 is found or all the candidates are tested. A candidate is defined to be of class 2 if the F0 value and the CS and SS scores associated with the candidate satisfy the condition:

$$(CS>C2 \text{ AND } SS>S2) \text{ AND } (F0 \text{ and } F0\text{ref are close each other}) \qquad \text{(Class 2 condition)}$$

where, C2=0.7, S2=0.7. If no class 2 candidate is found, at step 626, then the pitch estimate is set to indicate an unvoiced frame at step 628. Otherwise, the class 2 candidate is chosen as the preferred candidate and Find Best in Vicinity procedure is applied at step 630.

Then at step 632 the pitch estimate is set to the preferred candidate. After either one of the pitch estimate set steps 628 or 632 control is passed to update history step 670, and then exit at step 672.

Returning to the last conditional branching step 620, if On Stable Track condition is not met then control is passed to step 640 where a Continuous Pitch Condition is tested. This condition is considered met if the previous frame belongs to a continuous pitch track at least 2 frames long. If Continuous Pitch Condition is satisfied then at step 642 F0ref reference is set to the value estimated for the previous frame and a class 2 candidate search is done at step 644. If a class 2 candidate is found, at step 646, then it is selected as the preferred candidate and Find Best In Vicinity procedure is applied, at step 648, and the pitch estimate is set to the preferred Candidate, at step 650, followed by update history, at step 670. Otherwise, the control flows to step 660 likewise it happens if Continuous Pitch Condition test of step 640 fails.

At step 660 the candidates are scanned sequentially until a candidate of class 3 is found or all the candidates are tested. A candidate is defined to be of class 3 if the CS and SS scores associated with it scores satisfy the condition:

$$(CS>C3 \text{ OR } SS>S3) \qquad \text{(Class 3 condition)}$$

where, C3=0.85, S3=0.82. If no class 3 candidate is found, at step 662, then the pitch estimate is set to indicate an unvoiced frame at step 668. Otherwise, the class 3 candidate is selected as the preferred candidate, and Find Best in Vicinity procedure is applied at step 664. Then at step 666 the pitch estimate is set to the preferred candidate. After either one of the pitch estimate set steps 668 or 666 the control is passed to update history, at step 670.

At step 670 the pitch estimate associated with the previous frame is set to the new pitch estimate, and all the history information is updated accordingly.

The operation of Correlation Circuit 510 (see FIG. 5) will now be described. Correlation Circuit gets at input:

- a downsampled extended frame s(n), n=1,2, . . . , LDEF, where LDEF=floor(2*MaxPitch/DSF) is the filtered extended frame length divided by the downsampling factor and floor-rounded;
- a list {Ti} of (in general non-integral) lag values corresponding to the pitch candidates.

Correlation Circuit 510 produces a list of correlation values (correlation scores CS) for the pitch candidates corresponding to the lag values. Each correlation value is computed using a subset of the frame samples. The number of samples in the subset depends on the lag value. The subset is selected by maximizing the energy of the signal represented by it. Correlation values at two integral lags, viz., floor(Ti) and ceil(Ti), surrounding the non-integral lag Ti are computed. Then a correlation at Ti lag is approximated using the interpolation technique proposed in Y. Medan, E. Yair and D. Chazan, "Super resolution pitch determination of speech signals", IEEE Trans. Acouts., Speech and Signal Processing, vol. 39, pp.40–48, January 1991.

Figure 7:
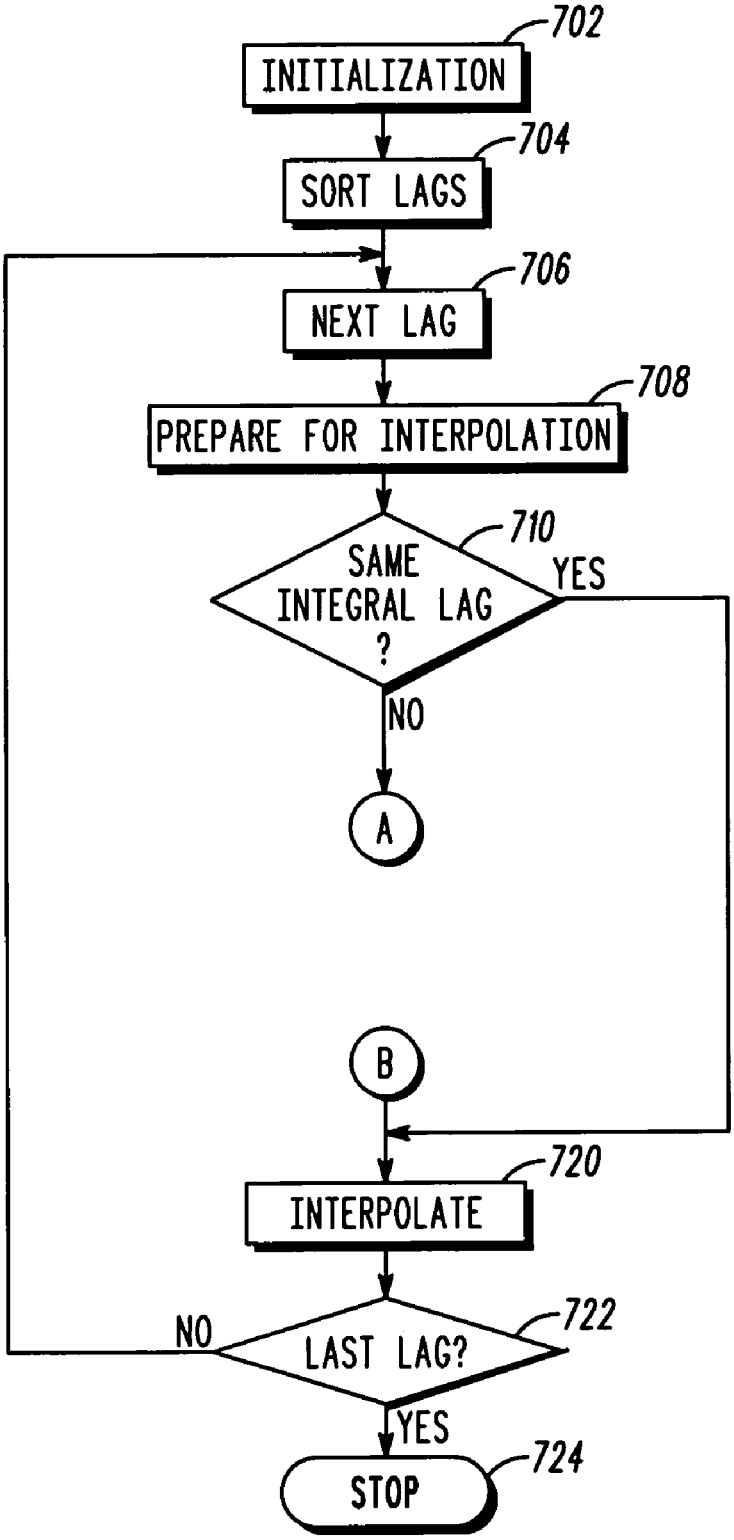
Figure 8:
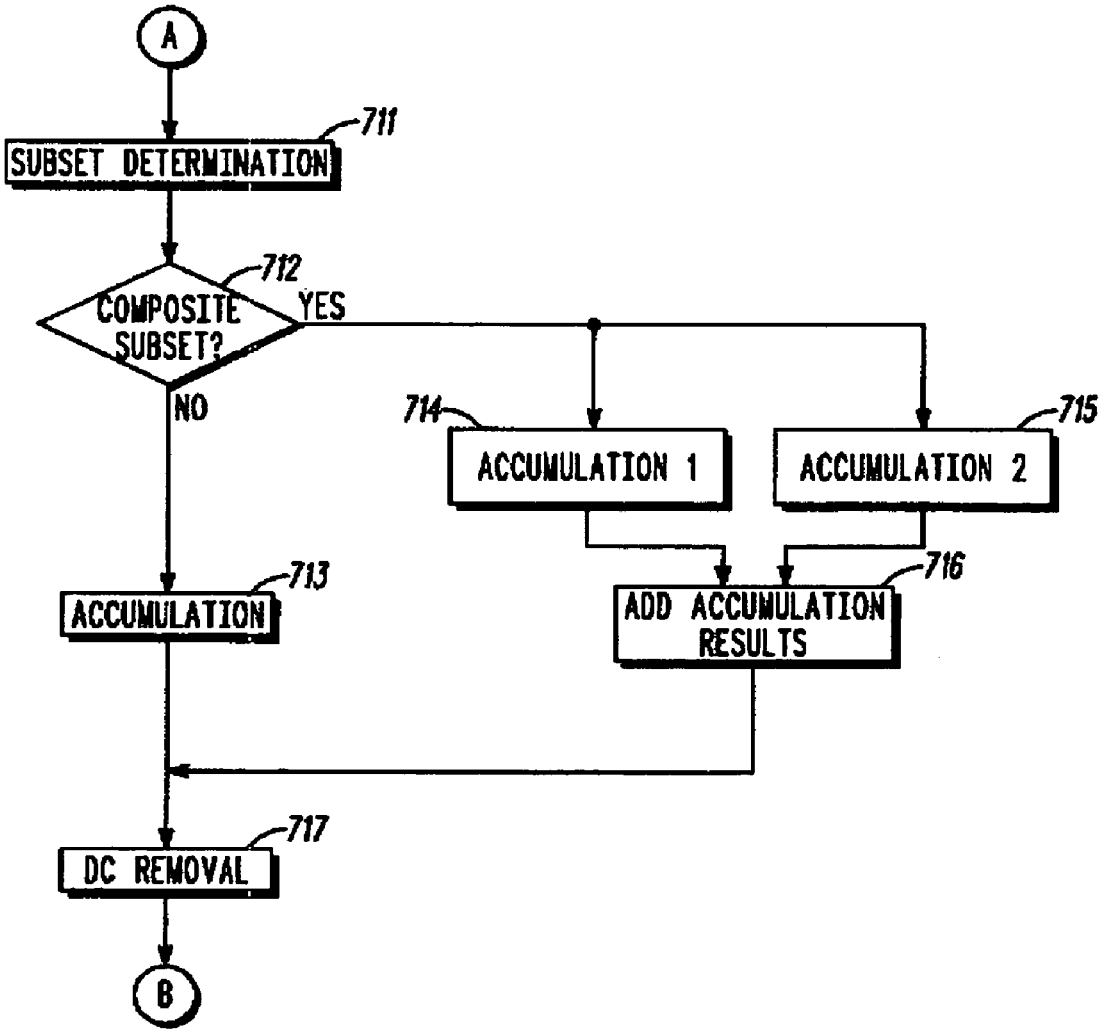
Figure 9:
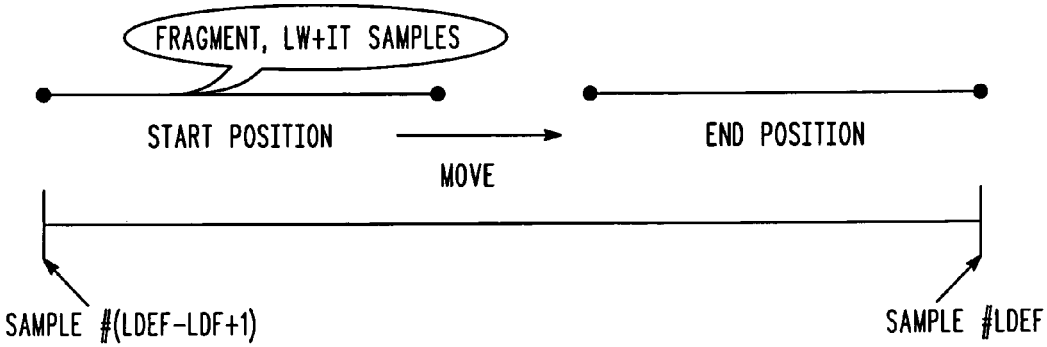
FIGS. 9 and 10 are time line vs. signal energy diagrams showing a time-domain signal analysis process according to a preferred embodiment of the present invention.
Figure 10:
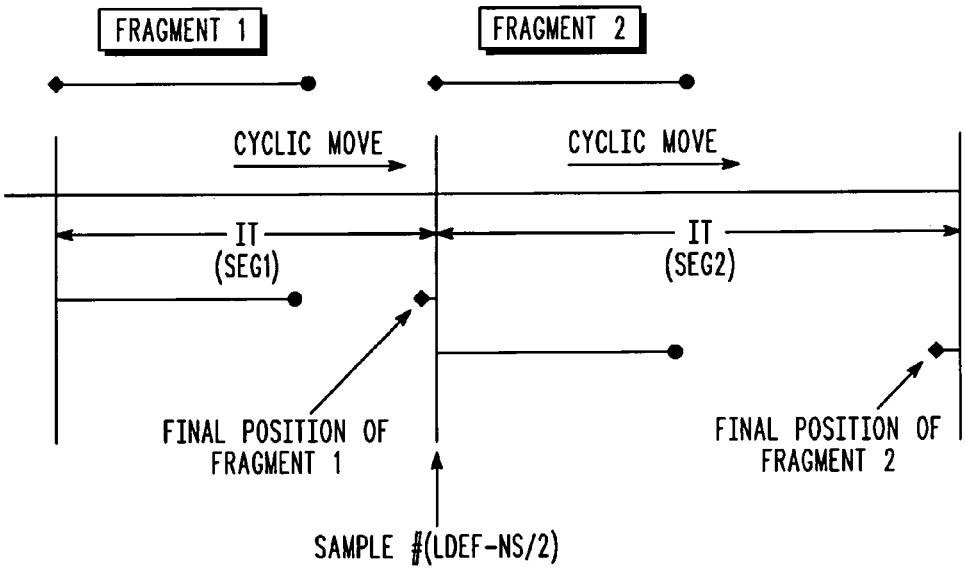

A reference is now made to FIGS. 7 and 8, which constitute a flow diagram illustrating operations relating to the Correlation Circuit 510. Reference is also made to FIGS. 9 and 10. At initialization step 702 an internal variable $IT_{last}$ representing a last integral lag is set to 0. All the input lag values are sorted in ascending order at step 704. At step 706 current lag T is set to the first lag. At interpolation preparing step 708 an integral lag IT=ceil(T) and an interpolation factor $\alpha$=IT-T are calculated. The integral lag value IT is compared to the last integral lag $IT_{last}$ at step 710. If the values are the same then the control flows to interpolation step 720. Otherwise, at step 711, a subset of samples is determined to be used for correlation score calculation. A subset is specified by one (a simple subset) or two (a composite subset) pairs (OS, LS) of parameters.

The integral lag IT is compared to a predefined window length LW=round ((75/DSF)*(SF/8000)).

If the integral lag IT is less than or equal to LW then a simple subset is determined as described further with reference to FIG. 9. Only LDF=LF/DSF last samples of the downsampled extended frame are used at this step, where LF is the frame duration in samples. That is, history is not used. A (LW+IT) samples long fragment is positioned at the beginning of the window comprised by the last LDF samples of the downsampled extended frame. The fragment energy (sum of squared values) is calculated. Then the fragment is moved one sample towards the end of the downsampled extended frame and the energy associated with the moved fragment is calculated. The process continues until the last sample of the fragment reaches the end of the downsampled extended frame. The position o of the most energetic fragment is selected:

$$o = \underset{LDEF-LDF \le m < LDEF-LW-IT}{\arg\max} \sum_{i=0}^{LW+IT-1} s(m+i)^2$$

The subset parameters are set to OS=o, LS=LW.

Otherwise, if the integral lag IT is greater than LW a subset is determined, at step 716, described further with reference to FIG. 10. A part of the downsampled extended frame to be used in this case depends on the IT value. Particularly NS=max(LDF, 2*IT) last samples are used, meaning that history is used only for long enough lag values. Two adjacent segments Seg1 and Seg2 each of length IT−1 are extracted from the frame at offset m1=(LDEF−NS/2−IT) and m2=(LDEF−NS/2) respectively. Each segment is considered to be a cyclic buffer representing a periodic signal. First, an LW samples long fragment1 is positioned at the beginning of the Seg1 segment. Similarly, an LW samples long fragment2 is positioned at the beginning of Seg2. The sum of the fragment energies is computed. Then the fragments are moved (simultaneously) one sample right (towards the end of the Segments), and the sum of the energies corresponding to the moved fragments is computed. The process continues even after a fragment reaches the rightmost position within its segment, and the shift operation is treated as a cyclic one. That is, a fragment is split into two parts, the left part is positioned at the beginning of the segment, and the right part is positioned at the end of the segment as is shown on FIG. 10. As the fragment moves its left part length decreases and the left part length increases. The maximal energy position o is selected:

$$o = \underset{0 \le m < IT}{\arg\max} \left[ \sum_{i=0}^{LW-1} Seg1((m+i) \bmod IT)^2 + \sum_{i=0}^{LW-1} Seg2((m+i) \bmod IT)^2 \right]$$

Two possibilities exist.

1) The offset o is small enough, particularly o<IT−LW. In this case a simple subset is defined and its parameters are set to OS=o+m1, LS=LW.

2) The offset o is large o>=IT−LW so that each subset is wrapped around the edges of the cyclic buffer. In this case a composite subset is defined (OS1=o+m1, LS1=IT−o) and (OS2=m1, LS2=LW−IT+o).

Returning to FIG. 8, at step 712, the flow is branched. If a simple subset has been determined then control is passed to step 713, otherwise steps 714 and 715 are performed in parallel. Each of the three processing steps (713, 714, 715) implements the same Accumulation procedure described below.

The input to the procedure are a subset parameters (OS, LS). Three vectors are defined, each of length LS.

$$X=\{x(i)=s(OS+i-1)\},$$

$$X1=\{x1(i)=s(OS+i)\},$$

$$Y=\{y(i)=s(OS+IT+i-1)\},$$

where, i=1,2, . . . , LS. Then squared norms (X,X), (X1,X1), and (Y,Y) of each vector as well as inner products (X,X1), (X,Y), and (X1,Y) of each vector pair are computed. Also a sum of all coordinates is computed for each vector: SX, SX1, SY. In case where a composite subsets have been determined, in step 714, the Accumulation procedure is applied to the (OS1, LS1) subset, and in step 715 the procedure is applied to the (OS2, LS2) subset. Then at step 716 the corresponding values produced by the Accumulation procedure are added.

At step 717 the squared norms and inner products are modified as follows:

$$(X,X)=(X,X)-SX^2/LW$$

$$(X1,X1)=(X1,X1)-SX1^2LW$$

$$(Y,Y)=(Y,Y)-SY^2/LW$$

$$(X,X1)=(X,X1)-SX\cdot SX1/LW$$

$$(X,Y)=(X,Y)-SX\cdot SY/LW$$

$$(X,X1)=(X,X1)-SX\cdot SX1/LW$$

The modified squared norms and inner products are stored for possible use while processing the next candidate lag value. The integral lag IT is saved as last integral lag.

At step 720, a correlation score is computed as follows.

$$D=\sqrt{(X,Y)\cdot((1-\alpha)^2\cdot(X,X)+2\cdot(1-\alpha)\cdot\alpha\cdot(X,X1)+\alpha^2\cdot(X1,X1))}$$

If D is positive CS=((X,Y)+α(X1,Y))/D, otherwise CS=0.

Control then flows to test step 722 where a check is made to find out if the last lag has been processed. If the answer is YES, then the process stops, at step 724. Otherwise control flows back to step 706 where the next lag is selected as the current lag to be processed.

The present invention can be realized in hardware, software, or a combination of hardware and software in clients 106, 108 or server 102 of FIG. 1. A system according to a preferred embodiment of the present invention, as described in FIGS. 5, 6, 7, 8, 9 and 10, can be realized in a centralized fashion in one computer system, or in a distributed fashion where different elements are spread across several interconnected computer systems. Any kind of computer system—or other apparatus adapted for carrying out the methods described herein—is suited. A typical combination of hardware and software could be a general-purpose computer system with a computer program that, when being loaded and executed, controls the computer system such that it carries out the methods described herein.

An embodiment of the present invention can also be embedded in a computer program product (in clients 106 and 108 and server 102), which comprises all the features enabling the implementation of the methods described herein, and which, when loaded in a computer system, is able to carry out these methods. Computer program means or computer program as used in the present invention indicates any expression, in any language, code or notation, of a set of instructions intended to cause a system having an information processing capability to perform a particular function either directly or after either or both of the following a) conversion to another language, code or, notation; and b) reproduction in a different material form.

A computer system may include, inter alia, one or more computers and at least a computer-readable medium, allowing a computer system, to read data, instructions, messages or message packets, and other computer-readable information from the computer-readable medium. The computer-readable medium may include non-volatile memory, such as ROM, Flash memory, Disk drive memory, CD-ROM, and other permanent storage. Additionally, a computer-readable medium may include, for example, volatile storage such as RAM, buffers, cache memory, and network circuits. Furthermore, the computer-readable medium may comprise computer-readable information in a transitory state medium such as a network link and/or a network interface, including a wired network or a wireless network, that allow a computer system to read such computer-readable information.

Figure 11:
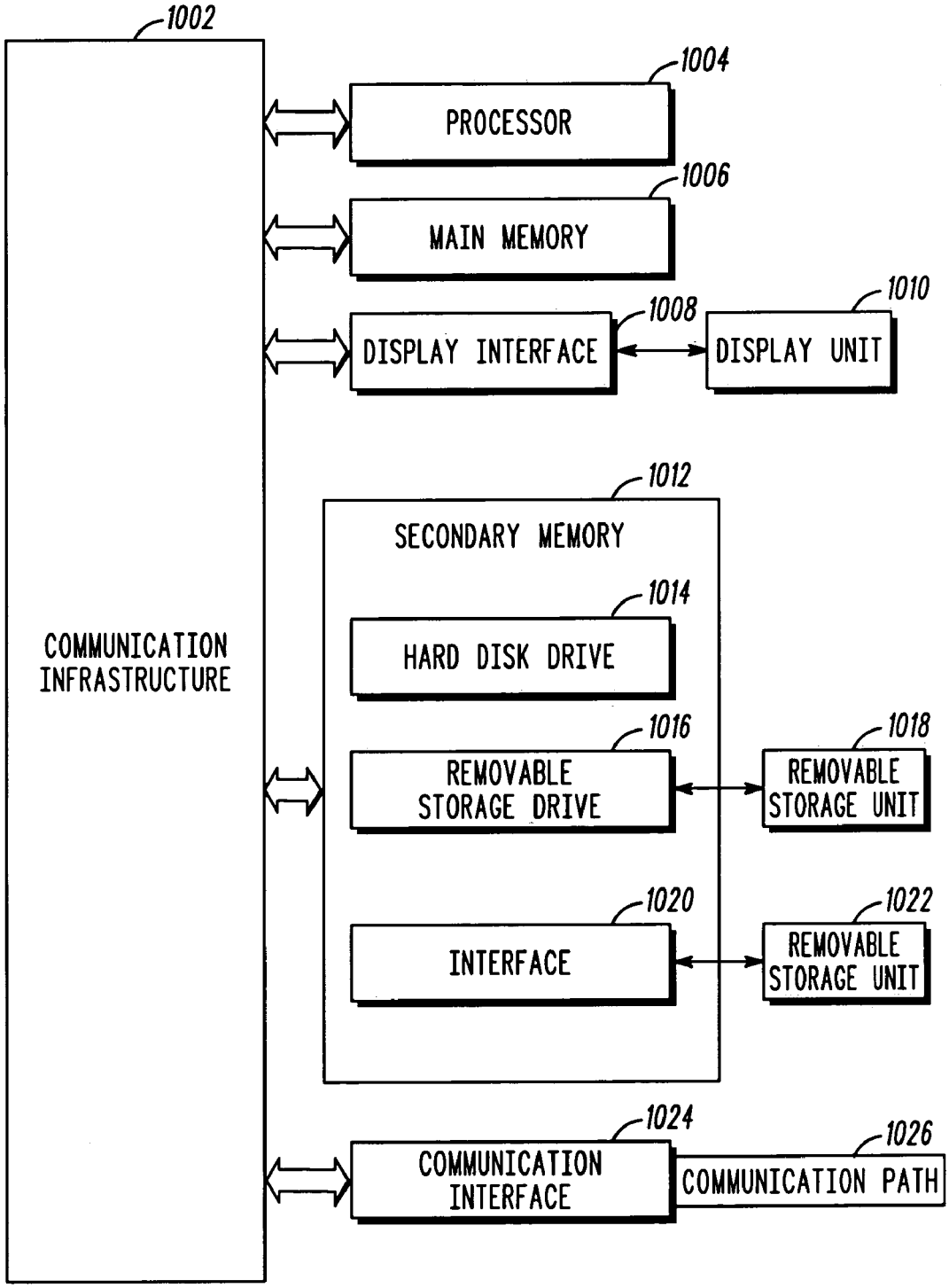
FIG. 11 is a block diagram of a computer system suitable for implementing a preferred embodiment of the present invention.

FIG. 11 is a block diagram of a computer system useful for implementing an embodiment of the present invention. The computer system of FIG. 11 is a more detailed representation of clients 106 and 108 and server 102. The computer system of FIG. 11 includes one or more processors, such as processor 1004. The processor 1004 is connected to a communication infrastructure 1002 (e.g., a communications bus, cross-over bar, or network). Various software embodiments are described in terms of this exemplary computer system. After reading this description, it will become apparent to a person of ordinary skill in the relevant art(s) how to implement the invention using other computer systems and/or computer architectures.

The computer system can include a display interface 1008 that forwards graphics, text, and other data from the communication infrastructure 1002 (or from a frame buffer not shown) for display on the display unit 1010. The computer system also includes a main memory 1006, preferably random access memory (RAM), and may also include a secondary memory 1012. The secondary memory 1012 may include, for example, a hard disk drive 1014 and/or a removable storage drive 1016, representing a floppy disk drive, a magnetic tape drive, an optical disk drive, etc. The removable storage drive 1016 reads from and/or writes to a removable storage unit 1018 in a manner well known to those having ordinary skill in the art. Removable storage unit 1018, represents a floppy disk, magnetic tape, optical disk, etc., which is read by and written to by removable storage drive 1016. As will be appreciated, the removable storage unit 1018 includes a computer usable storage medium having stored therein computer software and/or data.

In alternative embodiments, the secondary memory 1012 may include other similar means for allowing computer programs or other instructions to be loaded into the computer system. Such means may include, for example, a removable storage unit 1022 and an interface 1020. Examples of such may include a program cartridge and cartridge interface (such as that found in video game devices), a removable memory chip (such as an EPROM, or PROM) and associated socket, and other removable storage units 1022 and interfaces 1020 which allow software and data to be transferred from the removable storage unit 1022 to the computer system.

The computer system may also include a communications interface 1024. Communications interface 1024 allows software and data to be transferred between the computer system and external devices. Examples of communications interface 1024 may include a modem, a network interface (such as an Ethernet card), a communications port, a PCMCIA slot and card, etc. Software and data transferred via communications interface 1024 are in the form of signals which may be, for example, electronic, electromagnetic, optical, or other signals capable of being received by communications interface 1024. These signals are provided to communications interface 1024 via a communications path (i.e., channel) 1026. This channel 1026 carries signals and may be implemented using wire or cable, fiber optics, a phone line, a cellular phone link, an RF link, and/or other communications channels.

In this document, the terms "computer program medium," "computer-usable medium," "machine-readable medium" and "computer-readable medium" are used to generally refer to media such as main memory 1006 and secondary memory 1012, removable storage drive 1016, a hard disk installed in hard disk drive 1014, and signals. These computer program products are means for providing software to the computer system. The computer-readable medium allows the computer system to read data, instructions, messages or message packets, and other computer-readable information from the computer-readable medium. The computer-readable medium, for example, may include non-volatile memory, such as Floppy, ROM, Flash memory, Disk drive memory, CD-ROM, and other permanent storage. It is useful, for example, for transporting information, such as data and computer instructions, between computer systems. Furthermore, the computer-readable medium may comprise computer-readable information in a transitory state medium such as a network link and/or a network interface, including a wired network or a wireless network, that allow a computer to read such computer-readable information.

Computer programs (also called computer control logic) are stored in main memory 1006 and/or secondary memory 1012. Computer programs may also be received via communications interface 1024. Such computer programs, when executed, enable the computer system to perform the features of the present invention as discussed herein. In particular, the computer programs, when executed, enable the processor 1004 to perform the features of the computer system. Accordingly, such computer programs represent controllers of the computer system.

The novel system and related methods for extracting pitch information from a speech signal provide significant advantages for processing pitch information, such as for a speech recognition system or a speech encoding system. Distributed speech recognition systems will especially benefit from the novel system and pitch extraction methods of the present invention. Since distributed speech recognition front end devices, such as portable wireless devices, cellular telephones, and two-way radios, typically have limited computing resources, limited processing capability, and are battery operated, these types of devices will particularly benefit from the preferred embodiments of the present invention as has been discussed above.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

What is claimed is:

1. A method comprising:

sampling a speech signal;

dividing the sampled speech signal into overlapping frames;

extracting first pitch information from a frame using frequency domain analysis;

providing at least one pitch candidate, each being coupled with a spectral score, from the first pitch information, each of the at least one pitch candidate representing a possible pitch estimate for the frame;

determining second pitch information for the frame by calculating time domain correlation values at lag values selected based upon each of the at least one pitch candidate;

providing a correlation score for each of the at least one pitch candidate within the second pitch information; and selecting one of the at least one pitch candidate as a pitch estimate of the frame.

2. The method of claim 1, wherein the selecting comprises:

selecting as the pitch estimate one of the at least one pitch candidate that is associated with a best combination of spectral score and correlation score thereby indicating a pitch candidate with a best probability of matching the a pitch of the frame.

3. The method of claim 2, wherein the selecting comprises:

computing a corresponding match measure for each of the at least one of pitch candidate and a selected pitch estimate for a previous frame; and;

selecting the pitch estimate as the at least one pitch candidate that is associated with the best combination of spectral score, correlation score and match measure, thereby indicating the one pitch candidate with the best probability of matching the pitch of the frame.

4. The method of claim 1, wherein the at least one pitch candidate comprise not more than six pitch candidates representing not more than possible six pitch estimates for the frame.

5. The method of claim 1, wherein the spectral score of the at least one pitch candidate indicates a measure of compatibility of a pitch value with spectral peaks found in a spectrum of the frame.

6. The method of claim 1, wherein the determining second pitch information comprises:

combining the frame with the a previous frame into an extended frame; and computing a downsampled extended frame by low-pass filtering and down sampling the extended frame.

7. The method of claim 6, wherein the providing correlation score comprises:

calculation of cross correlation between two fragments of the downsampled extended frame.

8. The method of claim 7, wherein the two fragments are of a predefined length and are delayed relative to each other by a lag value corresponding to each of the at least one pitch candidate.

9. The method of claim 8, wherein the position of the two fragments within the downsampled extended frame is selected by maximizing the total energy of the fragments.

10. The method of claim 1, further comprising:

selecting a plurality of pitch estimates, the plurality of pitch estimates comprising a corresponding pitch estimate for each of a plurality of frames of the sampled speech signal; and coding a representation of the sampled speech signal, the representation comprising the plurality of pitch estimates.

11. The method of claim 10, wherein the representation of the sampled speech signal is used in a distributed speech recognition system.

12. A distributed speech recognition system comprising:

a distributed speech recognition front-end for extracting features of a speech signal, the distributed speech recognition front-end comprising:

a memory;

a processor, communicatively coupled with the memory; and a pitch extracting processor, communicatively coupled with the memory and the processor, for:

sampling a speech signal;

dividing the sampled speech signal into overlapped frames;

extracting first pitch information from a frame using frequency domain analysis;

providing at least one pitch candidate, each being coupled with a spectral score, from the first pitch information, each of the at least one pitch candidate representing a possible pitch estimate for the frame;

determining second pitch information for the frame by calculating time domain correlation values at lag values selected based upon each of the at least one pitch candidate;

providing a correlation score for each of the at least one pitch candidate within the second pitch information; and selecting one of the at least one pitch candidate as a pitch estimate of the frame.

13. The distributed speech recognition system of claim 12, wherein the pitch extracting processor for selecting:

selects the one of the at least one pitch candidate that is associated with a best combination of spectral score and correlation score thereby indicating a pitch candidate with the best probability of matching the pitch of a frame.

14. The distributed speech recognition system of claim 13, wherein the pitch extracting processor for selecting:

computes a corresponding match measure for each of the at least one of pitch candidate and a selected pitch estimate for a previous frame; and;

selects the pitch estimate as the at least one pitch candidate that is associated with the best combination of spectral score, correlation score and the match measure, thereby indicating the one pitch candidate with the best probability of matching the pitch of the frame.

15. The distributed speech recognition system of claim 12, wherein the at least one pitch candidate comprise not more than six pitch candidates representing not more than possible six pitch estimates for the frame.

16. The distributed speech recognition system of claim 12, wherein the spectral score of the at least one pitch candidate indicates a measure of compatibility of a pitch value with spectral peaks found in the spectrum of the frame.

17. The distributed speech recognition system of claim 12, wherein the pitch extracting processor for determining second pitch information:

combines the frame with a previous frame into an extended frame; and computes a downsampled extended frame by low-pass filtering and down sampling the extended frame.

18. The distributed speech recognition system of claim 17, wherein the pitch extracting processor for providing correlation score:

calculates a cross of correlation between two fragments of the downsampled extended frame.

19. The distributed speech recognition system of claim 18, wherein the two fragments are of a predefined length and are delayed relative to each other by a lag value corresponding to each of the at least one pitch candidate.

20. The distributed speech recognition system of claim 19, wherein the position of the two fragments within the downsampled extended frame is selected by maximizing the total energy of the fragments.

21. The distributed speech recognition system of claim 12, wherein the pitch extracting processor is further for:

selecting a plurality of pitch estimates, the plurality of pitch estimates comprising a corresponding pitch estimate for each of a plurality of frames of the sampled speech signal; and coding a representation of the sampled speech signal, the representation comprising the plurality of pitch estimates.

22. A computer readable medium comprising computer instructions for a speech processing system, the computer instructions including instructions for:

sampling a speech signal;

dividing the sampled speech signal into overlapped frames;

extracting first pitch information from a frame using frequency domain analysis;

providing at least one pitch candidate, each being coupled with a spectral score, from the first pitch information, each of the at least one pitch candidate representing a possible pitch estimate for the frame;

determining second pitch information for the frame by calculating time domain correlation values at lag values selected based upon each of the at least one pitch candidate;

providing a correlation score for each of the at least one pitch candidate within the second pitch information; and selecting one of the at feast one pitch candidate as a pitch estimate of the frame.

23. The computer readable medium of claim 22, wherein the selecting comprises:

selecting as the pitch estimate one of the at least one pitch candidate that is associated with a best combination of spectral score and correlation score thereby indicating a pitch candidate with a best probability of matching a pitch of the frame.

24. The computer readable medium of claim 22, wherein the selecting comprises:

computing a corresponding match measure for each of the at least one of pitch candidate and a selected pitch estimate for a previous frame; and selecting the pitch estimate as the at least one pitch candidate that is associated with best combination of spectral score, correlation score and match measure, thereby indicating one pitch candidate with the best probability of matching the pitch of the frame.

25. The computer readable medium of claim 22, wherein the spectral score of the at least one pitch candidate indicates a measure of compatibility of a pitch value with spectral peaks found in the spectrum of the frame.

26. The computer readable medium of claim 22, wherein the determining second pitch information comprises:

combining the frame with a previous frame into an extended frame; and computing a downsampled extended frame by low-pass filtering and down sampling the extended frame.

27. The computer readable medium of claim 26, wherein the providing correlation score comprises:

calculation of cross correlation between two fragments of the downsampled extended frame.

28. The computer readable medium of claim 27, wherein the two fragments are of a predefined length and are delayed relative to each other by a lag value corresponding to each of the at least one pitch candidate.

29. The computer readable medium of claim 22, wherein the computer instructions further including instructions for:

selecting a plurality of pitch estimates, the plurality of pitch estimates comprising a corresponding pitch estimate for each of a plurality of frames of the sampled speech signal; and coding a representation of the sampled speech signal, the representation comprising the plurality of pitch estimates.

30. The computer readable medium of claim 29, wherein the representation of the sampled speech signal is transmitted to another component of a distributed speech recognition system.

* * * * *